US008888490B2

(12) United States Patent
Cederwall

(10) Patent No.: US 8,888,490 B2
(45) Date of Patent: Nov. 18, 2014

(54) WIRELESS TARGET SYSTEM

(75) Inventor: Per Cederwall, Kullavik (SE)

(73) Assignee: Saab AB, Linköping (SE)

( * ) Notice: Subject to any disclaimer, the term of this patent is extended or adjusted under 35 U.S.C. 154(b) by 112 days.

(21) Appl. No.: 13/807,548

(22) PCT Filed: Jun. 29, 2011

(86) PCT No.: PCT/SE2011/050877

§ 371 (c)(1),
(2), (4) Date: Dec. 28, 2012

(87) PCT Pub. No.: WO2012/002898

PCT Pub. Date: Jan. 5, 2012

(65) Prior Publication Data

US 2013/0108990 A1 May 2, 2013

(30) Foreign Application Priority Data

Jun. 30, 2010 (WO) ..... PCT/SE2010/050754

(51) Int. Cl.

| | |
|---|---|
| ***F41A 33/00*** | (2006.01) |
| ***F41J 5/02*** | (2006.01) |
| ***F41J 2/00*** | (2006.01) |
| ***F41G 3/26*** | (2006.01) |

(52) U.S. Cl.

CPC . *F41A 33/00* (2013.01); *F41J 5/02* (2013.01); *F41J 2/00* (2013.01); *F41G 3/2688* (2013.01); *F41G 3/2655* (2013.01); *F41G 3/2666* (2013.01)

USPC ..... 434/16

(58) Field of Classification Search

CPC ..... F41G 3/2683
USPC ..... 434/16
See application file for complete search history.

(56) References Cited

U.S. PATENT DOCUMENTS

| | | | |
|---|---|---|---|
| 3,832,791 | A | 9/1974 | Robertsson |
| 6,283,756 | B1 | 9/2001 | Danckwerth et al. |
| 6,398,555 | B1 | 6/2002 | Gerber et al. |
| 2002/0045999 | A1 | 4/2002 | Bollweg et al. |
| 2004/0033472 | A1 | 2/2004 | Varshneya |

FOREIGN PATENT DOCUMENTS

| | | | |
|---|---|---|---|
| EP | 1598632 | A1 | 11/2005 |
| WO | WO-02/33341 | A1 | 4/2002 |
| WO | WO-02/084201 | A1 | 10/2002 |
| WO | WO-2010/058135 | A1 | 5/2010 |

OTHER PUBLICATIONS

PCT/ISA/210 - International Search Report - Oct. 3, 2011 (Issued in PCT/SE2011/050877).
PCT/ISA/237 - Written Opinion of the International Searching Authority - Oct. 3, 2011 (Issued in PCT/SE2011/050877).
PCT/ISA/210 - International Search Report -Mar. 1, 2011 (Issued in PCT/SE2010/050754).
PCT/ISA/237 - Written Opinion of the International Searching Authority -Mar. 1, 2011 (Issued in PCT/SE2010/050754).

*Primary Examiner* — Sam Yao
*Assistant Examiner* — Robert P Bullington
(74) *Attorney, Agent, or Firm* — Venable LLP; Eric J. Franklin

(57) ABSTRACT

A wireless target system unit for a weapon effect simulation system. A radio transmitter and receiver communicates with a control system. A laser receiver is arranged for receiving laser light from an attacking system. The wireless target system unit includes two retro-reflecting prisms arranged to retro-reflect an incident laser light from an attacking system. Each reflecting center of the retro-reflecting prisms and a sensor center of the laser receiver are mounted such that they form an isosceles triangle. The distance between the reflecting center of each retro-reflecting prism and the sensor center of the laser receiver are equal.

18 Claims, 5 Drawing Sheets

WIRELESS TARGET SYSTEM

CROSS-REFERENCE TO RELATED APPLICATIONS

The application is the national phase under 35 U.S.C. §371 of PCT/SE2011/050877 filed 29 Jun. 2011, which claims priority to PCT/SE2010/050754 filed 30 Jun. 2010.

TECHNICAL FIELD

The present invention relates to the field of military laser simulation systems between a wireless target system and attacking system.

The present invention relates to a wireless target system unit for a weapon effect simulation system, comprising a radio transmitter and receiver arranged for communication with a control system, the wireless target system unit further comprising a laser receiver arranged for receiving laser light from an attacking system.

The present invention further relates to a wireless target system for a weapon effect simulation, comprising at least one wireless target system unit, the wireless target system unit in turn comprising a radio transmitter and receiver arranged for communication with a control system, the wireless target system unit further comprising a laser receiver arranged to be receiving laser light from an attacking system, said wireless target system further comprising a wireless control unit.

BACKGROUND ART

Today, there exist various examples of wireless detector units detecting and receiving laser light from an attacking system. These wireless detector units are arranged to be able to detect laser light from an attacking system. The purpose is to create a laser weapon effect one-way simulation between the target system and the attacking system where the target system receives and detects laser light. These present solutions are restricted to one-way laser simulation which is restricted to a straight projectile path laser simulation without taking care of the target range, the projectile time of flight, the aiming off allowance and the ballistics data for the simulated projectile. Further, these present solutions are restricted to a low fidelity usage having a restricted power supply.

Today, there exist reference detector units which are connected with cables and wires. These reference detector units are arranged to be able to receive and detect laser light from an attacking system and to retro-reflect the laser light back to the attacking system for hit evaluation, i.e. two-way laser simulation. These present solutions are restricted to advanced and expensive equipments, and have a limited multi-purpose flexibility. Further, these present solutions are restricted to a time-consuming assembly, installation and configuration procedure.

There is thus a need for an improved and multi-purpose wireless target system unit and target system for a weapon effect simulation removing the above-mentioned disadvantages.

SUMMARY

Various examples of the invention are set forth by the following description and the accompanying drawings.

With the above description in mind, an aspect of the present invention is to provide a simplified and more accurate solution of the transfer of information during a two-way laser simulation between a wireless attacking and target system which seeks to mitigate, alleviate, or eliminate one or more of the above-identified deficiencies in the art and disadvantages separately or in any combination.

The object of the present invention is to provide an inventive, simplified and multi-purpose wireless target system unit detecting laser light and enabling a correct laser light transfer of information and avoiding a mismatch of information during a two-way laser simulation between a wireless target and attacking system. This object is achieved by a wireless target system unit for a weapon effect simulation system, comprising a radio transmitter and receiver for communication with a control system, the wireless target system unit further comprising a laser receiver arranged for receiving laser light from an attacking system, said laser light have a laser pulse pattern comprising of a first laser lobe, a second laser lobe and a third laser lobe. The wireless target system unit comprises two retro-reflecting prisms arranged to retro-reflect an incident laser light from an attacking system, wherein each reflecting centre of said retro-reflecting prisms and a sensor centre of said laser receiver are mounted such that they form an isosceles triangle. The distance between the reflecting centre of each said retro-reflecting prism and the sensor centre of said laser receiver are equal, wherein said isosceles triangle form of said reflecting centres of said retro-reflecting prisms and said sensor centre of said laser receiver is arranged to correspond with said laser pulse pattern. This allows the wireless target system unit to be used in a more efficient and multi-purpose way with a high accuracy, high stability and also a more accurate transfer of information and avoiding a mismatch of information, between the wireless target and the attacking system.

Said object is further achieved by a wireless target system for a weapon effect simulation, comprising at least one wireless target system unit, the wireless target system unit in turn comprising a radio transmitter and receiver for communication with a control system, the wireless target system unit further comprising a laser receiver arranged to be receiving laser light from an attacking system. The wireless target system further comprises a wireless control unit where the wireless target system unit comprises two retro-reflecting prisms arranged to retro-reflect an incident laser light from an attacking system, said laser light have a laser pulse pattern comprising of a first laser lobe, a second laser lobe and a third laser lobe, wherein each reflecting centre of said retro-reflecting prisms and a sensor centre of said laser receiver are mounted such that they form an isosceles triangle, and that the distance between the reflecting centre of each said retro-reflecting prism and the sensor centre of said laser receiver are equal, wherein said isosceles triangle form of said reflecting centres of said retro-reflecting prisms and said sensor centre of said laser receiver is arranged to correspond with said laser pulse pattern, and where wireless communication means are arranged for communication between the wireless target system unit and the wireless control unit. This gives a higher accuracy and stability to the wireless target system.

According to a further advantageous aspect of the invention, said retro-reflecting prisms are adapted to be easily replaceable with another set of prisms. According to a further advantageous aspect of the invention, said retro-reflecting prisms are of a different size. The retro-reflecting prisms are adapted to be changed to another set of prisms allowing the wireless target system unit to be flexible and to use retro-reflecting prism of different size and shape. This also simplifies maintenance and replacement of broken retro-reflecting prisms.

According to a further advantageous aspect of the invention, said wireless target system unit comprises a base unit and a casing.

According to a further advantageous aspect of the invention, said base unit comprises a radio transmitter and receiver, a sensor display with a laser receiver, a configuration button, a configuration number, a visual flash indicator and power supply means.

According to a further advantageous aspect of the invention, said power supply means for said wireless target system unit is a battery.

According to a further advantageous aspect of the invention, said casing comprises a first retro-reflecting prism, a second retro-reflecting prism, a configuration button cover, holders and casing openers.

According to a further advantageous aspect of the invention, said casing covers at least a part of the base unit. This gives a protection for the wireless target system unit and allows the wireless target system unit to be more robust, since the casing protects the base unit from impacts.

According to a further advantageous aspect of the invention, said casing is adapted to be changed to another casing. This is advantageous in that a worn and torn casing easily may be replaced. This is advantageous in that it allows for replacing the casing with another casing with different colour.

According to a further advantageous aspect of the invention, said distance between said reflecting centre of each said retro-reflecting prism and said sensor centre of the laser receiver is less than 300 mm, preferably in the range of 10 to 100 mm, more preferably in the range of 30 to 80 mm, most preferably in the range of 50 to 60 mm.

According to a further advantageous aspect of the invention, said retro-reflecting prisms are arranged to cover an angle of incident laser light, where the field of reflection for said wireless target system unit comprises a first angle coverage in horizontal direction and a second angle of coverage in vertical direction. The first angle of coverage in horizontal direction and the second angle of coverage in vertical direction both match the horizontal and vertical laser receiver coverage of the incident laser light.

According to a further advantageous aspect of the invention, said first angle of coverage is equal to or less than 180 degrees and preferably at least 110 degrees.

According to a further advantageous aspect of the invention, said second angle of coverage is equal to or less than 180 degrees and preferably at least 60 degrees.

According to a further advantageous aspect of the invention, said wireless target system unit further comprises a third retro-reflecting prism and a fourth retro-reflecting prism, each reflecting centre of the third retro-reflecting prism and a fourth retro-reflecting prism are also mounted in an isosceles triangle together with said laser receiver sensor centre. This gives flexibility and allows the wireless target system unit to increase the field of reflection and/or the range to the attacking system.

According to a further advantageous aspect of the invention, said radio transmitter and receiver with a radio antenna is mounted on the opposite side of the casing in relation to said retro-reflecting prisms. This allows for a low point of gravity for the wireless target system unit and an optimal stability for the wireless target system unit and also for a minimal interference with the radio communication. A further advantage of this is that it allows for minimal interference of the retro-reflecting prism from the sun light.

According to a further advantageous aspect of the invention, said wireless target system units are adapted to be removably attached.

A number of advantages are provided by means of the present invention, for example:

- a complete wireless target system is obtained having wireless communication allowing for two-way laser simulation;
- a multi-purpose wireless target system allowing for both one-way and two-way laser simulation together with flash indication;
- a plurality of different power sources is allowed for the wireless target system unit;
- a robust, flexible and simplified wireless target system unit is obtained;
- simplified assembly, installation, configuration and maintenance are allowed;
- a more accurate transfer of information and avoiding a mismatch of information, between the wireless target and attacking system, during a two-way laser simulation are allowed.

BRIEF DESCRIPTION OF THE DRAWINGS

The present invention will now be described in detail with reference to the figures, wherein.

It should be added that the following description of the examples is for illustration purposes only and should not be interpreted as limiting the invention exclusively to these examples/aspects.

DETAILED DESCRIPTION

Examples of the present invention relate, in general, to the field of weapon effect simulation systems, and in particular, to military simulation systems receiving laser light and reflecting laser light between wireless target systems and attacking systems while enabling an accurate transfer of information during a two-way laser simulation. The attacking system includes a laser pulse transceiver arranged to transmit and receive laser light, and the wireless target system are arranged to be retro-reflecting the laser light back to the attacking system. The laser light may be a simulated projectile. The laser pulses emitted from the attacking system are reflected back from the target. This indicates the precise range to the target to be determined and used in ballistic calculations that assesses whether a hit has been achieved. The attacking system, when used in two-way laser simulation, is measuring and calculating the target range, the projectile time of flight and performs a simplified hit evaluation in order to be able to transmit high precision coordinates for the projectile position in relation to the target system. The target system performs a detailed hit effect evaluation with the information from the received coded laser pulses from the attacking system, and also taking care of aiming off allowance, type of projectile and the ballistics data for the simulated projectile processed with the pre-programmed target vulnerability data.

Examples of the present invention will be described more fully hereinafter with reference to the accompanying drawings, in which examples of the invention are shown. This invention may, however, be embodied in many different forms and should not be construed as limited to the examples set forth herein. Rather, these examples are provided so that this disclosure will be thorough and complete, and will fully convey the scope of the invention to those skilled in the art. Like reference signs refer to like elements throughout.

Figure 1:
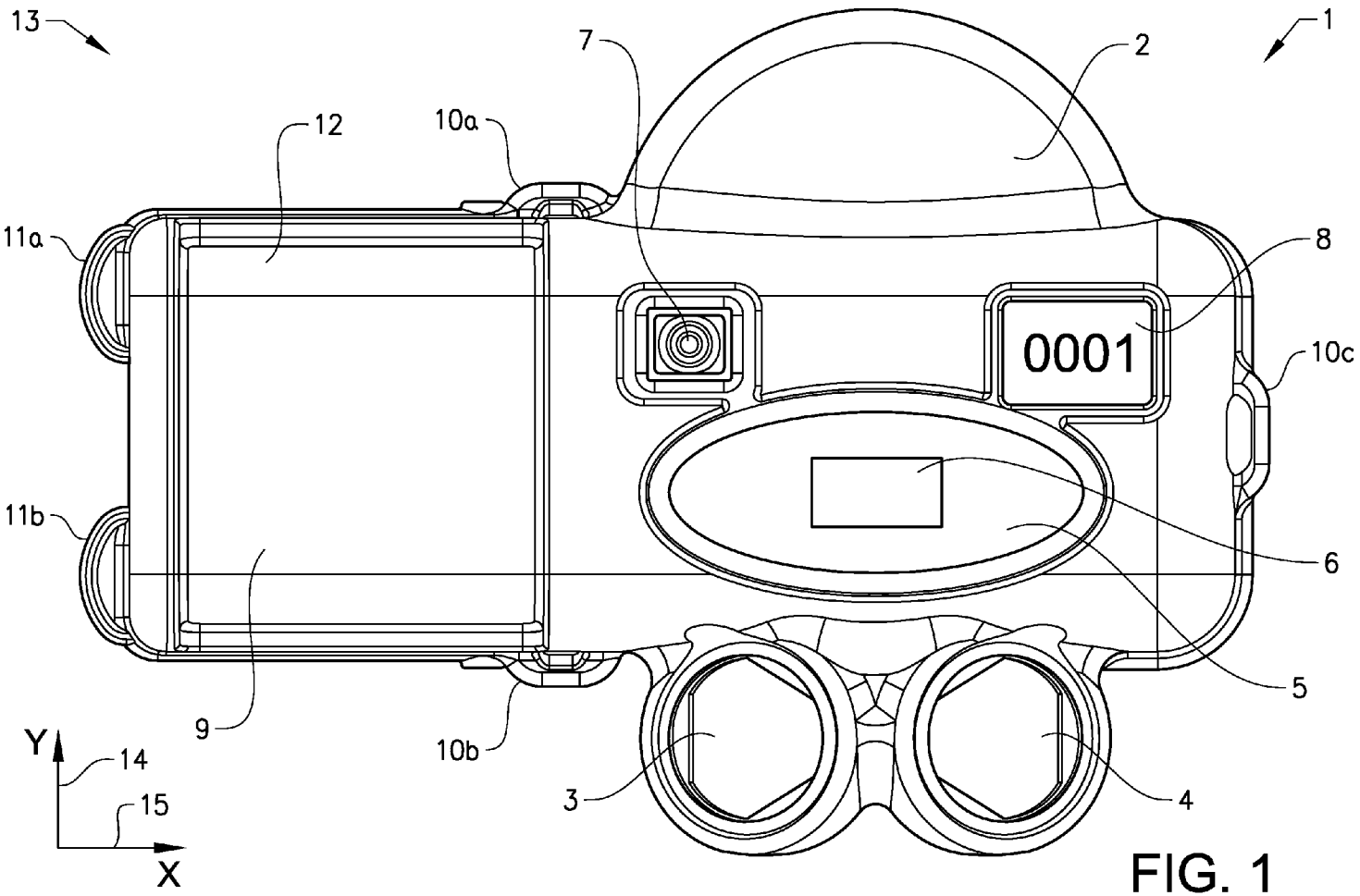
FIG. 1 schematically shows a front view pictorial representation of a wireless target system unit in accordance with the present invention.

All the FIGS. 1 to 6 are schematically illustrated. FIG. 1 shows an example of the wireless target system unit 1 according to the invention for detecting and receiving laser light and enabling a correct laser light transfer of information and avoiding a mismatch of information during a two-way laser simulation between a wireless target and attacking system. The wireless target system unit 1 is a flexible target system unit comprising a radio transmitter and receiver 2 with an antenna, a laser receiver 6 for receiving and detecting laser light, a first retro-reflecting prism 3 and a second retro-reflecting prism 4, each retro-reflecting prism being arranged for reflecting laser light back to the attacking system. The horizontal direction is represented by the X-axis 15 and the vertical direction is represented by the Y-axis 14. When in optimal use, the X-axis 15 of the wireless target system unit 1 is parallel with the horizontal direction and the Y-axis 14 of the wireless target system unit 1 is parallel with the vertical direction. However, the wireless target system unit may also be used when the X- and Y-axis are not parallel to the horizontal and vertical direction.

The wireless target system unit 1 is arranged to be mounted to a target. The target can constitute any type of land-, sea or air based object. The target can constitute a vehicle in the form of, for example, a helicopter, a tank, a track-mounted vehicle, a truck or other wheeled vehicle. The target can, for example, further constitute a building or an infantry training participant.

Referring to FIG. 1, the wireless target system unit 1 comprises a base unit 13 and a casing 12. The base unit 13 comprises a radio transmitter and receiver 2 with an antenna, a sensor display 5 with a laser receiver 6, a configuration button, a configuration number 8, a visual flash indicator, for example comprising light emitting diodes and power supply means, such as a battery 9. The casing 12 comprises a first retro-reflecting prism 3, a second retro-reflecting prism 4, a configuration button cover 7, holders 10*a*, 10*b*, 10*c* and casing openers 11*a*, 11*b*.

The casing 12 is adapted to be easily fitted around the base unit 13 and to be changed to another casing allowing different prisms to be used. The retro-reflecting-prisms 3, 4 are attached to the casing 12. The retro-reflecting prisms may be of different size and shape. The retro-reflecting prisms may constitute prism for short range or long range. The retro-reflecting prisms may constitute any appropriate type of retro-reflecting prism. The wireless target system unit 1 has functionality in both one-way laser and two-way laser simulations, since the casing 12 with the retro-reflecting prisms is easily removable and attachable. When the casing 12 comprising the retro-reflecting prisms is fitted to the base unit 13, the wireless target system unit 1 allows for both one-way laser simulation and two-way laser simulation depending of the capability of the attacking system. When the casing 12 is not fitted to the base unit 13, the base unit 13 allows for one-way laser simulation. It is also possible to integrate the retro-reflecting units together with the base unit 13 if there is no need to remove, replace or exchange them. It is also possible to design a casing without retro-reflecting prisms 3, 4 which may provide robustness during one-way laser simulation.

The casing 12 is an easily removable covering further comprising openings for the sensor display 5, the configuration identification number 8 and for the rear side (not shown). The casing 12 is preferably made from a light and elastic material, such as a polymer, elastomer or rubber. However, the casing may be made of any suitable material. The casing 12 is attached to the base unit 13 via a flange construction around the rim of the base unit 13. The casing 12 can easily be snapped on and off the base unit 13 by using the flange construction of the base unit 13 and the corresponding track construction of the casing 12. The holders 10*a*, 10*b*, 10*c* may be used for fastening the wireless target unit 1 to a target, by using straps, catch wires or the like. The holders 10*a*, 10*b*, 10*c* constitutes through holes in the casing 12. The casing openers 11*a*, 11*b* protrudes from the casing 12 in such a way as to facilitate the removal and attachment of the casing 12, from and to the base unit 13. Referring to FIG. 1, the casing openers 11*a*, 11*b* are positioned on the casing 12 at the end of the battery 9.

The casing 12 is environmentally tight, and when it is fitted to the base unit 13 it constitutes a robust protection for the base unit 13; the casing 12 thus protects the base unit 13 from impact forces. When the casing 12 is fitted to the base unit 13, the casing 12 functions as a lid to the battery 9. In order to get access to change the battery 9, the casing 12, functioning as a lid, may only be partly opened and removed by using the casing openers 11*a* and 11*b*. Further, the casing 12 comprises a configuration button cover 7 protecting the configuration button of the base unit 13. The configuration button cover 7 is formed such that it is possible to press down on the configuration button while having the casing 12 attached to the base unit 13. The configuration number 8 shows the configuration number of the wireless target system unit 1 in a wireless target system. The configuration number 8 is a unique identification number for the wireless target system unit 1. This configuration number may be a fixed number or a changeable number showing in a display. The casing 12 may be constituted by any appropriate material or colour.

The sensor display 5 may be formed in an elliptic shape. The elliptic sensor display 5 comprises the laser receiver 6, the visual flash indicator and a visual configuration set-up display. The laser receiver 6 may comprise one or several PIN diodes arranged to detect the incoming laser light from an attacking system. The visual flash indicator may comprise high intensive light emitting diodes signalling elimination of the wireless target system unit 1. The visual configuration set-up display presents the configuration of the wireless target system units 1 in a wireless target system. The visual configuration set-up display presents how the wireless target system unit 1 is configured and where to be positioned on the front, rear, left or right side of a target. The sensor display 5 may comprise an IR-interface. The visual configuration set-up display may also present a result of a built-in test function and support the user in case of reconfiguration.

Normally a Velcro attachment (not shown) on the rear side of the wireless target system unit 1 is used to attach the wireless target system unit 1 to a target. This reduces the cost by simplifying the assembly, installation, configuration and maintenance of the wireless target system unit. However, the wireless target system unit 1 can be mounted to a target by any conventional fastening means such as for example wire means, screws or bolts. Further, the wireless target system unit 1 may signal if the power supply is not sufficient.

The wireless target system unit 1 is arranged to cover an angle of incident laser light, where the field of reflection for the wireless target system unit 1 comprises a first angle coverage in the horizontal direction and a second angle of coverage in the vertical direction in relation to the positioning of the wireless target system unit. The first angle of coverage in horizontal direction and the second angle of coverage in vertical direction both match the horizontal and vertical laser receiver coverage of the incident laser light. The first angle of coverage is equal or less than 180 degrees and preferably at least 110 degrees. The second angle of coverage is equal or less than 180 degrees, preferably at least 60 degrees. Referring to FIG. 1, the retro-reflecting prism 3, 4 are normally directed at an outward angle of 22,5 degrees in each direction and in relation to the normal vector direction of the laser receiver 6. The field of reflection for the wireless target system unit 1 match the field of the laser receiver coverage for the wireless target system unit 1.

Figure 2:
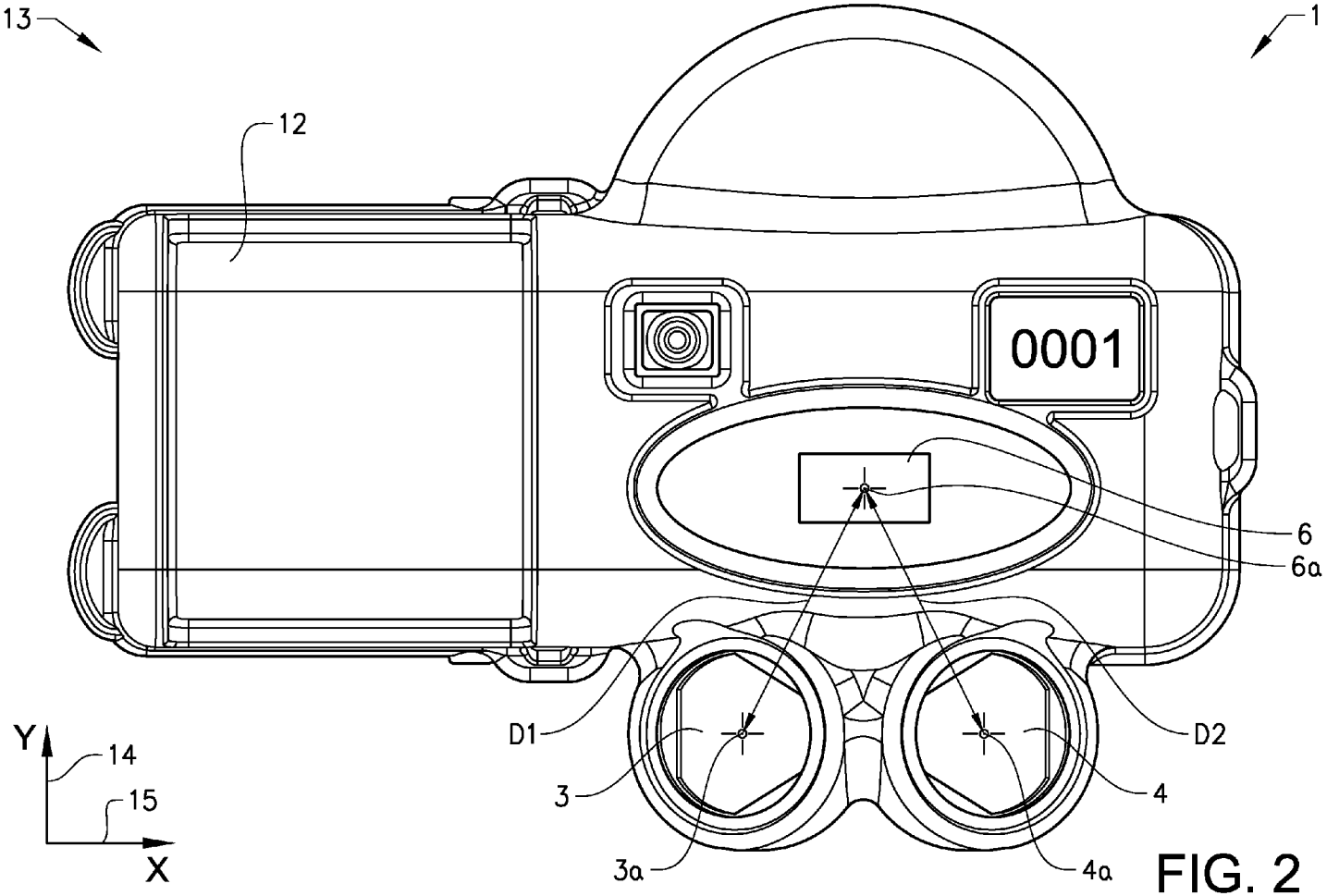
FIG. 2 schematically shows a front view pictorial representation of a wireless target system unit in accordance with the present invention.

FIG. 2 shows a front view of the example of FIG. 1. FIG. 2 shows the sensor centre 6*a* of the laser receiver 6, the reflecting centre 3*a* of the first retro-reflecting prism 3 and the reflecting centre 4*a* of the second retro-reflecting prism 4. The reflecting centres 3*a*, 4*a* of the retro-reflecting prisms 3, 4 and the sensor centre 6*a* of the laser receiver 6 are mounted such that they form an isosceles triangle. The distance to the reflecting centre of each said retro-reflecting prism 3, 4 and the sensor centre 6*a* of the laser receiver 6 are equal. The first distance D1, between the reflecting centre 3*a* of the first retro-reflecting prism 3 and the sensor centre 6*a* of the laser receiver 6, is equal to the second distance D2, between the reflecting centre 4*a* of the second retro-reflecting prism 4*a* and the sensor centre 6*a* of the laser receiver 6.

The geometrical shape of an isosceles triangle constitutes of two sides which are equal in length. An isosceles triangle also has two angles of the same measure; namely, the angles opposite to the two sides of the same length. By having the reflecting centres 3*a*, 4*a* of the retro-reflecting prisms 3, 4 and the sensor centre 6*a* of the laser receiver 6 in a geometrical shape of an isosceles triangle, a more accurate transfer of information and avoiding a mismatch of information during a two-way laser simulation with high fidelity is obtained. Each reflecting centre of the retro-reflecting prisms and the sensor centre of said laser receiver are mounted such that they constitute the corners of an isosceles triangle. The isosceles triangle which is created between the reflecting centres 3*a*, 4*a* of said retro-reflecting prisms 3, 4 and the sensor centre 6*a* of the laser receiver 6 enables a simultaneous detection, by the laser receiver 6, and reflection, by the retro-reflecting prism 3, 4, of the passing laser light from an attacking system.

The accuracy of transferring information between a wireless target system unit 1 and an attacking system with laser light is depending on the simultaneous detection and reflection of the laser light at the wireless target system unit 1. When determining the range and position between the attacking system and the target system during a two-way laser simulation, the laser light from an attacking system is reflected back to the attacking system and analysed in the attacking system before the projectile position coordinates, the type of projectile and the ballistic data are transmitted to the target system by coded laser pulses allowing the target system to calculate an accurate hit effect evaluation. The attacking system, when used in two-way laser simulation, is measuring and calculating the target range, the projectile time of flight and performs a simplified hit evaluation in order to be able to transmit high precision coordinates for the projectile position in relation to the target system. The target system performs a detailed hit effect evaluation with the information from the received coded laser pulses from the attacking system, and also taking care of aiming off allowance, type of projectile and the ballistics data for the simulated projectile processed with the pre-programmed target vulnerability data. This indicates the range to the target to be determined and used in ballistic calculations that assesses whether a hit has been achieved and results are presented in both the attacking system and in the target system.

Figure 3B:
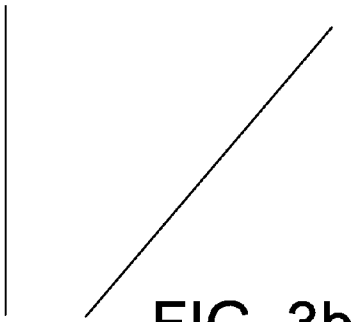
FIG. 3*b* schematically shows a laser light of an attacking system, where the laser light have a laser pulse pattern.
Figure 3A:
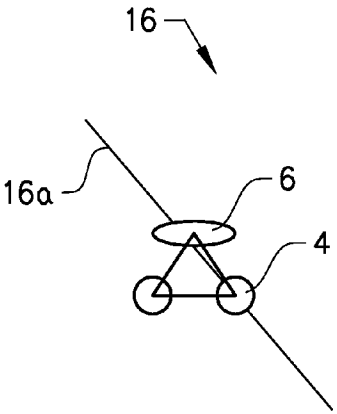
FIG. 3*a* schematically shows a laser light of an attacking system, where the laser light have a laser pulse pattern.
Figure 3A:
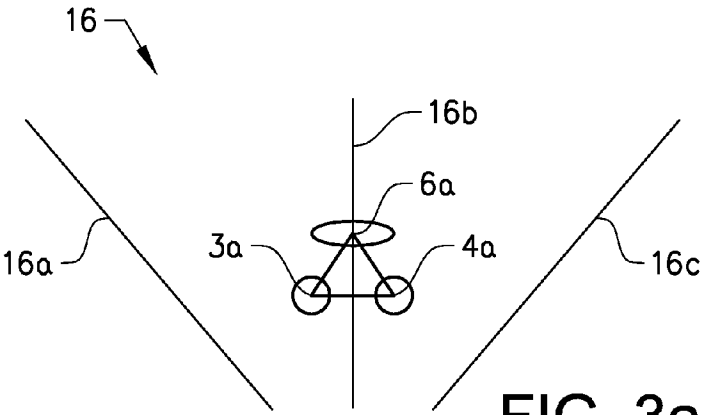

FIG. 3*a* shows a laser light of an attacking system, where the laser light have a laser pulse pattern 16 and where the reflecting centres 3*a*, 4*a* of the retro-reflecting prisms and the sensor centre 6*a* of the laser receiver are mounted such that they constitute the corners of an isosceles triangle. FIG. 3*a* shows an example of the laser pulse pattern 16 comprising of a first laser lobe 16*a*, a second laser lobe 16*b* and a third laser lobe 16*c*. This laser pulse pattern 16 of the attacking system is preferred to enable an accurate transfer of information for all ranges between the wireless target system unit 1 and the attacking system.

Figure 3C:
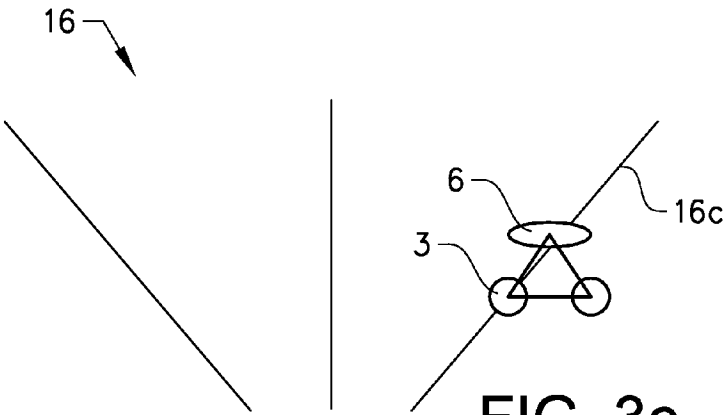
FIG. 3*c* schematically shows a laser light of an attacking system, where the laser light have a laser pulse pattern.

The laser pattern 16 from the attacking system and the geometrical shape of the isosceles triangle between the reflecting centres 3*a*, 4*a* and the sensor centre 6*a* of the wireless target system unit guarantees symmetrical characteristics independent of the direction of the laser light from the attacking system. The angle between the first laser lobe 16*a* and the second laser lobe 16*b* is 45 degrees and the angle between the second laser lobe 16*b* and the third laser lobe 16*c* is 45 degrees. The first laser lobe 16*a*, the second laser lobe 16*b* and the third laser lobe 16*c* constitute a fixed laser pulse pattern 16 in relation to each other which is simultaneously transmitted from the attacking system. The width of the first laser lobe 16*a*, the second laser lobe 16*b* and the third laser lobe 16*c* at impact of incoming laser light on the wireless target system unit varies with the distance between the attacking system and the wireless target system unit. The width of the laser lobes becomes narrower as the distance between the attacking system and the wireless target system unit becomes shorter During operation of the attacking system, the laser pulse pattern 16 sweeps from left to right and from right to left which is schematically shown in FIG. 3*b* and FIG. 3*c*. FIG. 3*b* shows a simultaneous laser light impact on the second retro-reflecting prism 4 and the laser receiver 6 with the first laser lobe 16*a* which enables a simultaneous retro-reflection and laser receiver detection of incoming laser light. FIG. 3*c* shows a simultaneous laser light impact on the first retro-reflecting prism 3 and the laser receiver 6 with the third laser lobe 16*c* which enables a simultaneous retro-reflection and laser receiver detection of incoming laser light. Thus, due to the geometrical shape of the isosceles triangle between the reflecting centres 3*a*, 4*a* and the sensor centre 6*a* of the wireless target system unit and due to the laser pulse pattern 16 symmetrical characteristics independent of the direction of the laser light from the attacking system are provided with the present invention. Any other geometrical form between the reflecting centres 3*a*, 4*a* and the sensor centre 6*a* will not provide such symmetrical characteristics and such simultaneous detection and reflection and accurate transfer of information for all ranges between the wireless target system unit and the attacking system.

The need for simultaneous detection and reflection and accurate transfer of information are required to get corresponding results in both the target and attacking system. The geometrical shape and relation of an isosceles triangle between the laser receiver 6 and the retro-reflecting prisms 3, 4 is preferred to enable an accurate transfer of information for all ranges between the wireless target system unit 1 and the attacking system. The laser pulse pattern 16 comprising of the first laser lobe 16*a*, the second laser lobe 16*b* and the third laser lobe 16*c* is also preferred to enable an accurate transfer of information for all ranges between the wireless target system unit 1 and the attacking system. When the distance between the wireless target system unit 1 and the attacking system is less than 100 meters, the geometrical shape and relation of an isosceles triangle between the laser receiver 6 and the retro-reflecting prisms 3, 4 is even more preferred, in order to achieve an accurate transfer of information. This is due to the narrow laser lobes which are transmitted from the attacking systems at short ranges.

During optimal function of the wireless target system unit, the same information is received from the laser light, independent of the direction of the attacking system, this since the wireless target system unit 1 has the geometrical shape and relation of an isosceles triangle between the laser receiver 6 and the retro-reflecting prisms 3, 4 which guarantees symmetrical characteristics independent of the direction of the simulated projectile from the attacking system. Optimal geometrical position of the wireless target system unit 1 is when the retro-reflecting prisms 3, 4 are parallel to the X-axis.

The distance D1, D2 between said reflecting centre 3*a*, 4*a* of each said retro-reflecting prism 3, 4 and said sensor centre 6*a* of the laser receiver 6 are normally less than 300 mm, preferably in the range of 10 to 100 mm, more preferably in the range of 30 to 80 mm, most preferably in the range of 50 to 60 mm.

The radio transmitter and receiver 2 with the radio antenna is mounted on the opposite side of said retro-reflecting prisms 3, 4. The retro-reflecting prisms 3, 4 are also mounted below both the radio transmitter and receiver 2 and the laser receiver 6. This results in minimal interference to the radio transmitter and receiver 2 with the radio antenna and increases the range of the radio transmitter and receiver 2 with the radio antenna. The wireless target system unit 1 with the relation of an isosceles triangle between the laser receiver 6 and the retro-reflecting prisms 3, 4 on the opposite side of the radio transmitter and receiver 2 with the radio antenna, further achieves a low centre of gravity increasing the stability of the wireless target system unit 1 and simplifies installation of the wireless target system unit 1 to a target.

Figure 4:
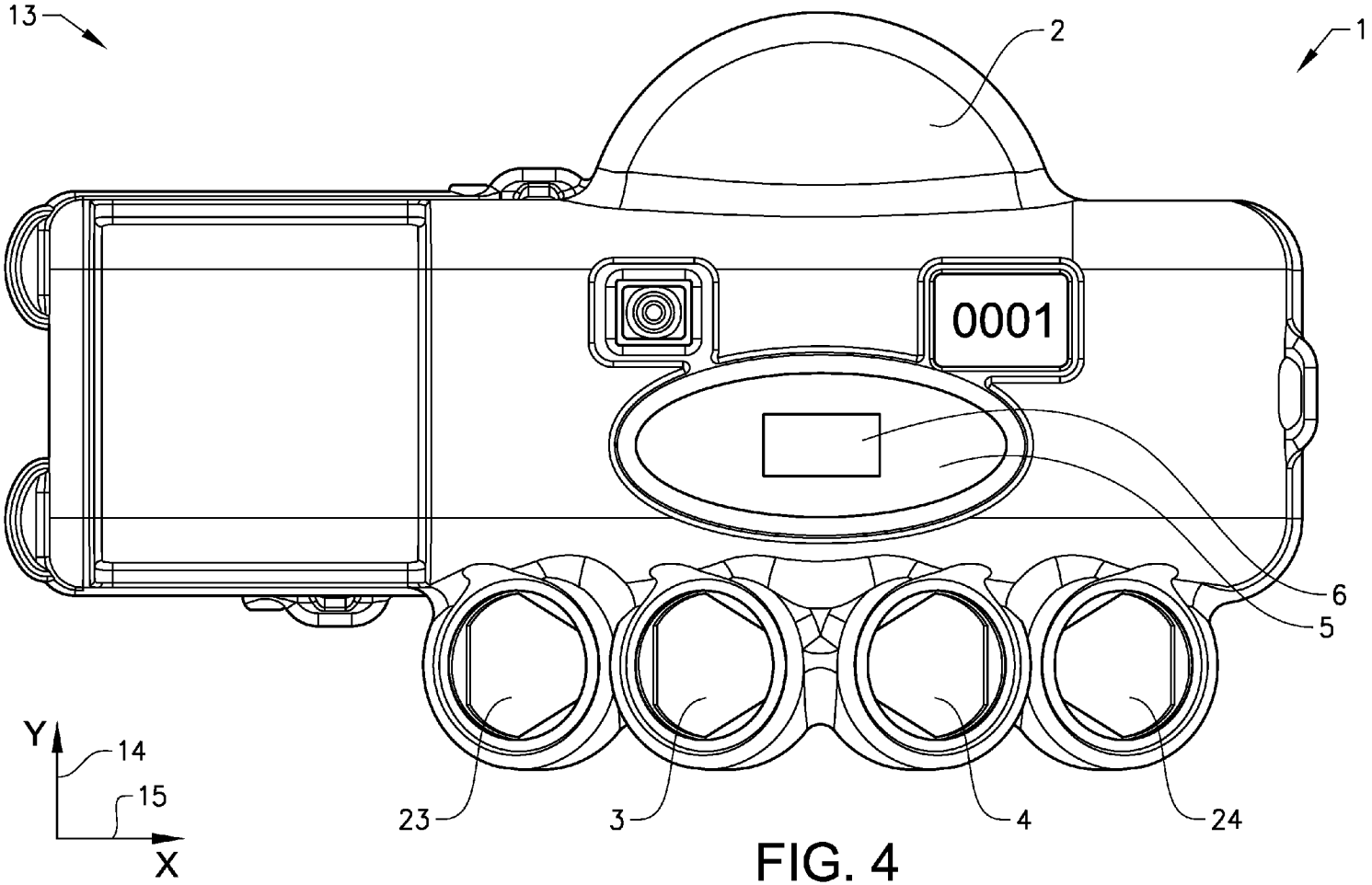
FIG. 4 schematically shows a front view pictorial representation of a wireless target system unit with an additional set of retro-reflecting prisms in accordance with the present invention.

FIG. 4 shows a front view of a further example of the wireless target system unit 1. FIG. 4 shows an example of a wireless target system unit 1 comprising an additional set of retro-reflecting prisms 23, 24. These additional retro-reflecting prisms, at an angle between each other, may increase both the first and second angle of coverage for the inclining laser light and/or increase the effective range to the attacking system when it performs two-way laser simulation. The reflecting centres (not shown) of the additional retro-reflecting prisms 23, 24 are also mounted in an isosceles triangle together with the sensor centre 6*a* of the laser receiver 6.

Figure 5:
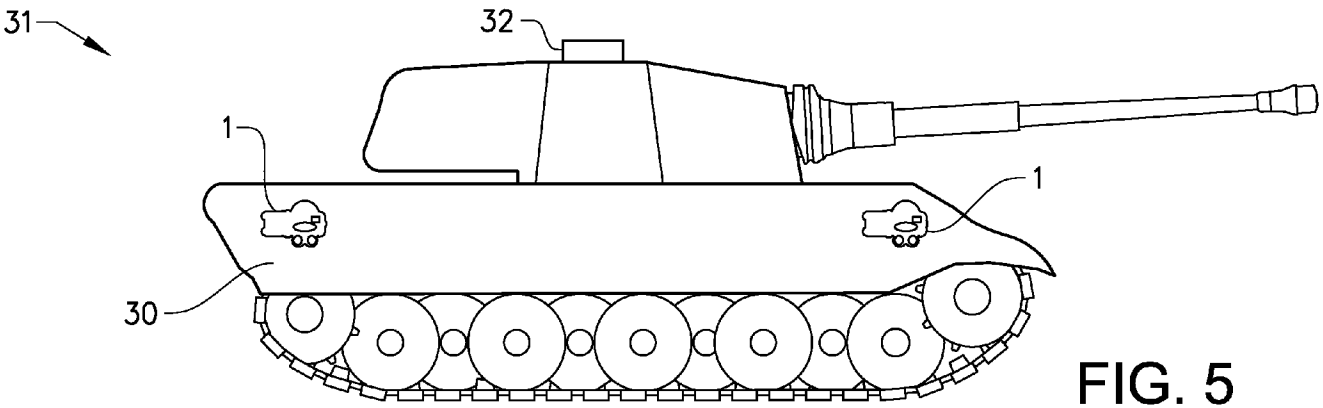
FIG. 5 schematically shows a pictorial representation of a tank comprising a wireless target system.

FIG. 5 shows a side view of a tank 30 comprising a wireless target system 31. FIG. 5 shows a side view of a tank 30, two wireless target system units 1 mounted on a first side 36 of the tank 30 and a wireless control unit 32 mounted on the upper part 37 of the tank 30. The wireless control unit 32 is arranged to register and analyse the data information received from the wireless target system units 1 in the wireless target system.

Figure 6:
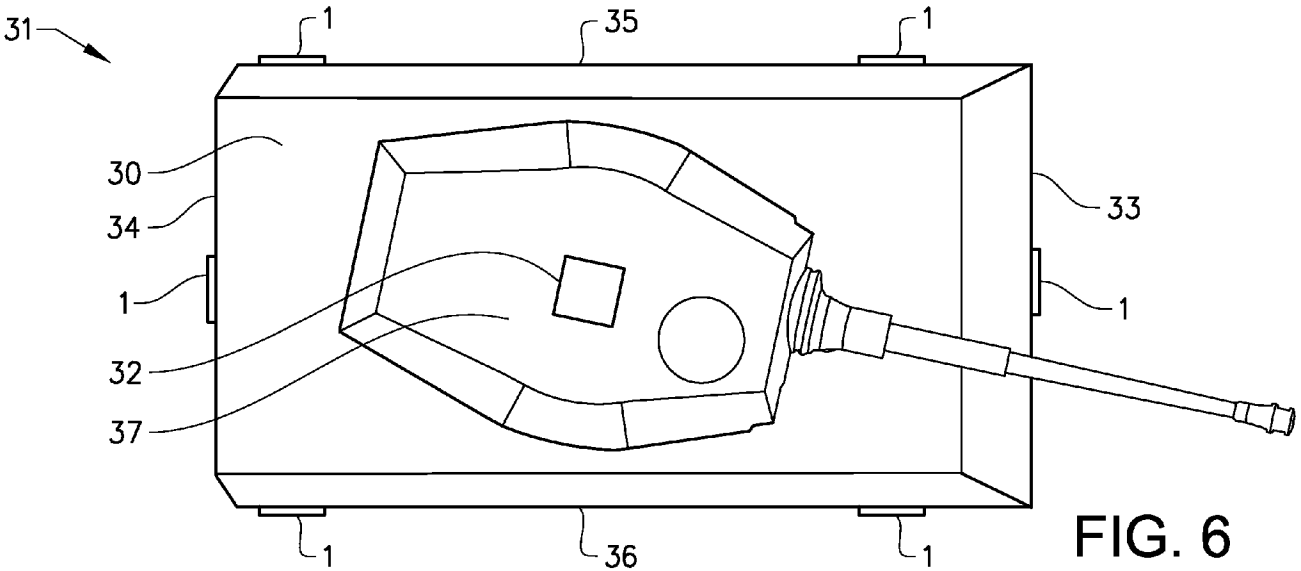
FIG. 6 schematically shows a top plan view of a tank comprising a wireless target system unit.

FIG. 6 shows a top plan view of a tank 30 comprising a wireless target system 31. In the example of FIGS. 5 and 6, two wireless target system units 1 are mounted on a first side 36 of the tank 30, two wireless target system units are mounted on a second side 35 of the tank 30, one wireless target system unit 1 is mounted on the front side 33 of the tank 30, one wireless target system unit 1 is mounted on the rear side 34 of the tank 30 and a wireless control unit 32 is mounted on the upper part 37 of the tank 30.

In a wireless target system 31, the wireless target system unit or units together with a wireless control unit 32 creates a radio network. This radio network may also be defined as a wireless detector network or a wireless network. The radio network is created with the wireless network transceiver function which is built in to all radio communicating units in the radio network. The wireless target system unit 1 and the wireless control unit comprise a wireless network transceiver function. The wireless target system units 1 may comprise one or several control process units which enable calculations to be done directly in the wireless target system unit 1. The wireless control unit 32 comprises one or several control process units allowing for calculations to be done in the wireless control unit 32.

The wireless target system unit 1 is arranged to receive and detect laser light from an attacking system and to transfers this laser light information via a radio transmitter and receiver 2 to the wireless control unit 32. The wireless control unit 32 comprises a radio transmitter and receiver in order to receive the information transmitted from the wireless target system unit 1. The wireless control unit 32 is arranged to calculate the resulting effect of the laser light detected by the wireless target system units 1 and to inform this result. For example, if the target is eliminated the resulting effect is kill, if the target is partly eliminated the resulting effect is mobility kill and if the target is hit but no damage was done to the target the resulting effect is hit with no effect.

The wireless control unit 32 further comprises a storage unit. The wireless control unit 32 may calculate and store the hit aspect angle of the laser simulated projectile from the attacking system. For example, a wireless target system 31 comprising several position defining wireless target system units 1 can determine which of the wireless target system units 1 that are hit with high intensity laser light and thus determine from what direction the wireless target system was hit. This information is presented by the aspect angle for the system. During a two-way laser simulation, the wireless control unit 32 may calculate and store the hit position and the aspect angle of the laser simulated projectile from the attacking system.

The wireless control unit 32 may store geographical positions from a GPS and may identify all positions and timings for each event during the simulation.

The wireless control unit 32 may identify the attacking simulation system and the ammunition used by the attacking system. The wireless control unit may signal if the power supply is not sufficient. Further, the wireless control unit 32 may communicate and instruct the wireless target system units to signal elimination with visual flash indication comprising of high intensive light emitting diodes.

The wireless target system unit 1 can receive, detect and decode laser pulses. For example, the wireless target system unit 1 may operate together with both laser code systems OSAG (Optische Schnittstelle für AGDUS and GefÜbZ) and MILES (Multiple Integrated Laser Engagement System). The wireless target system unit 1 may decode the received laser pulses and further transmit information to the wireless control unit 32. The wireless target system unit 1 comprises a repeater function and may receive information from other wireless target units and transmit this information to the control unit 32.

The wireless target system unit 1 may comprise an IR-interface and may communicate with other IR-interface units, for example other simulation systems. The IR-interface may be used for software loading. The wireless target system may comprise an IR-interface and may communicate with other IR-interface units, for example other simulation systems. The wireless target system may be configured by using the IR-interface in both the wireless target system and the wireless target system unit 1. A configuration of the wireless target system may be done by holding the IR-interface in the wireless target system unit 1 in front of the IR-interface of the wireless control unit and adjusting the configuration with the configuration button and the visual configuration set-up display where the position of the wireless target system unit 1 is presented. However, the configuration may be done by using radio communication or a programmable laser control gun.

A vehicle target is normally provided with a total of six wireless system units 1, two on each side of the vehicle target, one at the front side 33 of the vehicle target and one at the rear side 34 of the vehicle target. However, a system set-up with four wireless target system units 1 in an orthogonal direction with each other is sufficient to cover 360 degrees in azimuth direction around the vehicle target. A wireless target system may comprise of any appropriate number of wireless target system units 1 and one wireless control unit 32.

Further, the wireless control unit 32 is not needed when the target is a fixed object, such as a building.

Further, the wireless target system units 1 for two-way laser simulation may be combined with base units 13 for one-way laser simulation in a wireless target system.

Any type of appropriate laser having any type of appropriate laser pattern, pulse or code may be used in the simulation systems.

The invention is not limited to the example described above, but may be modified without departing from the scope of the claims below.

The terminology used herein is for the purpose of describing particular examples only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

The foregoing has described the principles, preferred examples and modes of operation of the present invention. However, the invention should be regarded as illustrative rather than restrictive, and not as being limited to the particular examples discussed above. The different features of the various examples of the invention can be combined in other combinations than those explicitly described. It should therefore be appreciated that variations may be made in those examples by those skilled in the art without departing from the scope of the present invention as defined by the appended claims.

REFERENCE SIGNS

1: Wireless target system unit
2: Radio receiver and transmitter
3: First retro-reflecting prism
3*a*: Reflecting centre of the first retro-reflector
4: Second retro-reflecting prism
4*a*: Reflecting centre of the second retro-reflector
5: Sensor display
6: Laser receiver
6*a*: Sensor centre of the laser receiver
7: Configuration button cover
8: Configuration number
9: Power supply means
10*a, b, c*: Holders
11*a, b*: Casing opener
12: Casing
13: Base unit
14: Y-axis
15: X-axis
16: Laser pulse pattern
16*a*: First laser lobe
16*b*: Second laser lobe
16*c*: Third laser lobe
23: Third retro-reflector
24: Fourth retro-reflector
30: Tank
31: Tank comprising a wireless target system
32: Wireless control unit
33: Front side
34: Rear side
35: Second side
36: First side
37: Upper part
D1: First distance (distance from centre of first retro-reflector to centre of laser receiver)
D2: Second distance (distance from centre of second retro-reflector to centre of laser receiver)

The invention claimed is:

1. A wireless target system unit for a weapon effect simulation system, said wireless target system unit comprising:
- a control system;
- a radio transmitter and receiver arranged for communication with said control system;
- a laser receiver arranged for receiving laser light from an attacking system;
- two retro-reflecting prisms arranged to retro-reflect an incident laser light from an attacking system, said laser light have a laser pulse pattern comprising of a first laser lobe, a second laser lobe and a third laser lobe, wherein each of said retro-reflecting prisms comprises a reflecting center and said laser receiver comprises a sensor center, wherein said reflecting center of each prism and said sensor center are mounted such that they form an isosceles triangle, and wherein a distance between said reflecting center of each said retro-reflecting prism and said sensor center of said laser receiver are equal, wherein said isosceles triangle form of said reflecting centers of said retro-reflecting prisms and said sensor center of said laser receiver is arranged to correspond with said laser pulse pattern.

2. The wireless target system unit according to claim 1, wherein said retro-reflecting prisms are adapted to be replaceable to another set of prisms by a user.

3. The wireless target system unit according to claim 2, wherein said retro-reflecting prisms are of a different size.

4. The wireless target system unit according to claim 1, further comprising:

a base unit; and a casing.

5. The wireless target system unit according to claim 4, wherein said base unit comprises said radio transmitter and receiver, said sensor display with said laser receiver, a configuration button, a configuration number, a visual flash indicator and a power supply.

6. The wireless target system unit according to claim 5, wherein said power supply for said wireless target system unit is a battery.

7. The wireless target system unit according to claim 4, wherein said casing comprises said first retro-reflecting prism, said second retro-reflecting prism, a configuration button cover, holders and casing openers.

8. The wireless target system unit according to claim 4, wherein said casing covers at least a part of said base unit.

9. The wireless target system unit according to claim 4, wherein said casing is adapted to be replaceable with at least one other casing.

10. The wireless target system unit according to claim 1, wherein each distance between said reflecting center of each said retro-reflecting prism and said sensor center of said laser receiver is less than 300 mm.

11. The wireless target system unit according to claim 1, wherein said retro-reflecting prisms are arranged to cover an angle of incident laser light, wherein said field of reflection for said wireless target system unit comprises a first angle of coverage in horizontal direction and a second angle of coverage in vertical direction both matching said laser receiver coverage of incident laser light.

12. The wireless target system unit according to claim 11, wherein said first angle of coverage is equal to or less than 180 degrees.

13. The wireless target system unit according to claim 11, wherein said second angle of coverage is equal to or less than 180 degrees.

14. The wireless target system unit according to claim 1, further comprising:

a third retro-reflecting prism and a fourth retro-reflecting prism, wherein said third retro-reflecting prism and said fourth retro-reflecting prism each comprise a reflecting center being mounted such that said reflecting center of said third and fourth reflecting centers form an isosceles triangle together with said laser receiver sensor center.

15. The wireless target system unit according to claim 1, wherein said radio transmitter and receiver is mounted on an opposite side of said casing in relation to said retro-reflecting prisms.

16. A wireless target system for a weapon effect simulation, the wireless target system comprising:

at least one wireless target system unit comprising a control system, a radio transmitter and receiver arranged for communication with said control system, a laser receiver arranged to receive laser light from an attacking system, two retro-reflecting prisms arranged to retro-reflect an incident laser light from an attacking system, said laser light have a laser pulse pattern comprising of a first laser lobe, a second laser lobe and a third laser lobe, wherein each of said retro-reflecting prisms comprises a reflecting center and said laser receiver comprises a sensor center, wherein said reflecting centers of said retro-reflecting prisms and sensor center are mounted such that they form an isosceles triangle, and wherein a distance between said reflecting center of each said retro-reflecting prism and said sensor center of said laser receiver are equal, wherein said isosceles triangle form of said reflecting centers of said retro-reflecting prisms and said sensor center of said laser receiver is arranged to correspond with said laser pulse pattern; and a wireless control unit, wherein said wireless target system unit and said wireless control unit comprise a wireless network transceiver.

17. The wireless target system according to claim 16, wherein said wireless target system units are adapted to be removably attached.

18. A vehicle, comprising: a wireless target system unit comprising a control system, a radio transmitter and receiver arranged for communication with said control system, a laser receiver arranged for receiving laser light from an attacking system, two retro-reflecting prisms arranged to retro-reflect an incident laser light from an attacking system, said laser light have a laser pulse pattern comprising of a first laser lobe, a second laser lobe and a third laser lobe, wherein each retro-reflecting prism comprises a reflecting center and said laser receiver comprises a sensor center, wherein said reflecting center of each prism and said sensor center are mounted such that they form an isosceles triangle, and wherein a distance between said reflecting center of each said retro-reflecting prism and said sensor center of said laser receiver are equal, wherein said isosceles triangle form of said reflecting centers of said retro-reflecting prisms and said sensor center of said laser receiver is arranged to correspond with said laser pulse pattern.

* * * * *